United States Patent [19]

Nagel

[11] Patent Number: 4,574,772

[45] Date of Patent: Mar. 11, 1986

[54] AIR DISTRIBUTING DEVICE

[76] Inventor: Vernon Nagel, R.R. 2, Box 78K, Herrin, Ill. 62948

[21] Appl. No.: 704,072

[22] Filed: Feb. 21, 1985

Related U.S. Application Data

[63] Continuation of Ser. No. 628,120, Jul. 9, 1984, abandoned, which is a continuation of Ser. No. 350,270, Feb. 19, 1982, abandoned.

[51] Int. Cl.[4] ..... F24B 1/18

[52] U.S. Cl. ..... 126/120; 126/143; 126/140; 126/202

[58] Field of Search ..... 126/120, 121, 143, 138, 126/140, 139, 112, 77, 146, 285 A, 202

[56] References Cited

U.S. PATENT DOCUMENTS

| | | | |
|---|---|---|---|
| 2,947,486 | 2/1950 | Barber | 126/120 |
| 3,162,188 | 12/1964 | Tompers | 126/140 |
| 3,870,032 | 3/1975 | Lydle et al. | 126/202 |
| 4,062,344 | 12/1977 | Mayes | 126/120 |
| 4,195,618 | 4/1980 | Kellogg et al. | 126/121 X |
| 4,256,084 | 3/1981 | Engleman | 126/121 |
| 4,372,288 | 2/1983 | Nicholas | 126/143 |

FOREIGN PATENT DOCUMENTS

| | | | |
|---|---|---|---|
| 9882 | of 1843 | United Kingdom | 126/121 |

*Primary Examiner*—Randall L. Green
*Attorney, Agent, or Firm*—Rey Eilers

[57] ABSTRACT

An air distributing device, for a fireplace that is equipped with an air conduit which can conduct outside air to that fireplace, has a lower air-guiding section adjacent the bottom of the fireplace opening, has an upper air-guiding section adjacent the top of that fireplace opening, has an air inlet in that lower air-guiding section which can receive outside air from that air conduit, has a plurality of air outlet ports in that lower air-guiding section and has an adjustable air-throttling means to control the amount of air which can pass from those air outlet ports into the fireplace, and has a plurality of air outlet ports in that upper air-guiding section and has an adjustable air-throttling means to control the amount of air which can pass from those air outlet ports into the fireplace. The adjustable air-throttling means can be adjusted to supply desired amounts of combustion-supporting air to the lower area of the fireplace or to supply desired amounts of above-fire air to the upper area of the fireplace.

5 Claims, 11 Drawing Figures

FIG. 9.
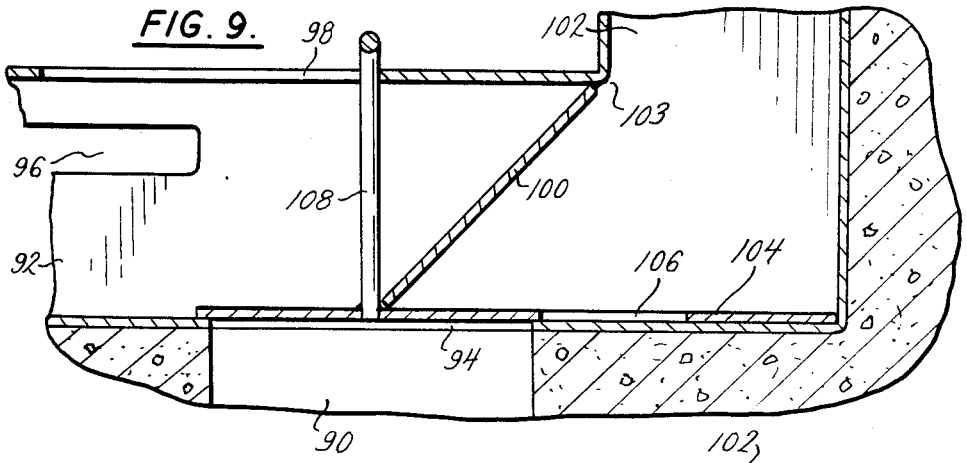
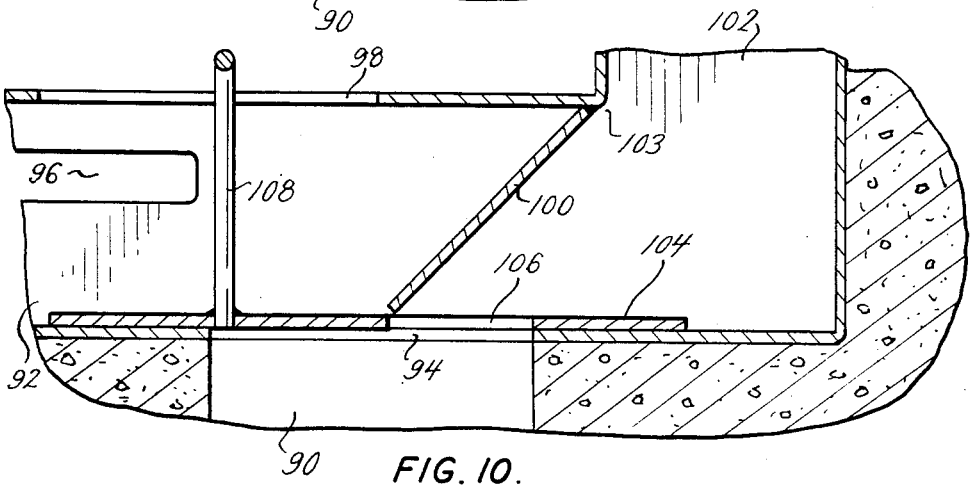
FIG. 10.
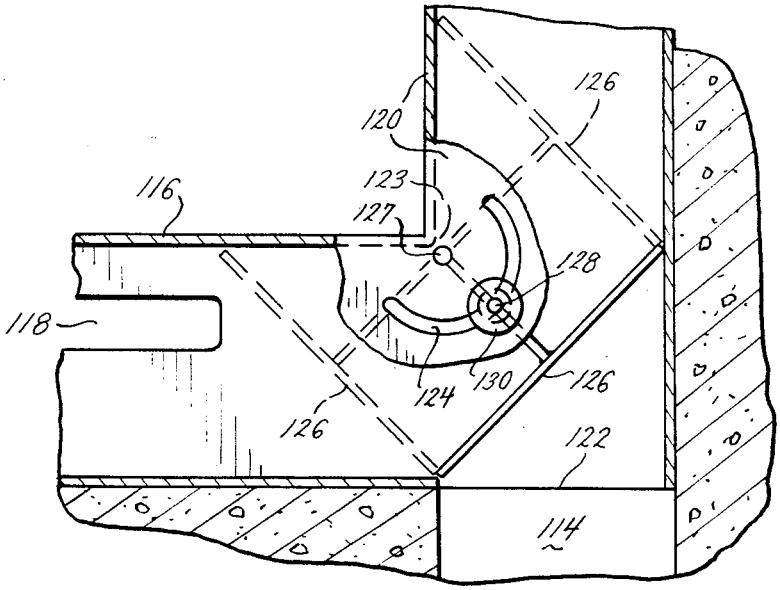
FIG. 11.

AIR DISTRIBUTING DEVICE

This is a continuation of application Ser. No. 628,120, filed July 9, 1984, which is a continuation of application Ser. No. 350,270, filed Feb. 19, 1982, both abandoned.

BACKGROUND OF THE INVENTION

Draft-controlling devices frequently are provided for fireplaces. Some of those draft-controlling devices include ports and air-throttling means which determine the amount of air that can pass from those ports into the fireplaces.

SUMMARY OF THE PRESENT INVENTION

The present invention provides an air distributing device for a fireplace that is equipped with an air conduit which can conduct outside air to that fireplace; and that air distributing device has a lower air-guiding section which (a) is adjacent the bottom of the fireplace opening, (b) has an air inlet that is in communication with the air conduit to receive outside air, (c) has a plurality of air outlet ports, and (d) has an adjustable air-throttling means to control the amount of outside air which can pass from those air outlet ports into the fireplace. The air outlet ports of that lower air-guiding section are positioned to permit outside air, that successively passes through the air conduit and that lower air-guiding section and those air outlet ports, to enter the lower area of the fireplace to support the combustion of the fuel within that fireplace. The air distributing device also has an upper air-guiding section which (a) is adjacent the top of the fireplace opening, (b) receives outside air, (c) has a plurality of air outlet ports, and (d) which has an adjustable air-throttling means to control the amount of outside air which can pass from those air outlet ports into the fireplace. The air outlet ports of that upper section are positioned to permit outside air, that successively passes through the air conduit and that upper air-guiding section and those air outlet ports, to enter the upper area of the fireplace to serve as above-fire air. It is, therefore, an object of the present invention to provide an air distributing device, for a fireplace that is equipped with an air conduit which can conduct outside air to that fireplace, with a lower air-guiding section adjacent the bottom of the fireplace opening, with an upper air-guiding section adjacent the top of that fireplace opening, and with adjustable air-throttling means that determine the amount of outside air which can enter the lower area or the upper area of the fireplace.

Other and further objects and advantages of the present invention should become apparent from an examination of the drawing and accompanying description.

In the drawing and accompanying description, some preferred embodiments of the present invention are shown and described but it is to be understood that the drawing and accompanying description are for the purpose of illustration only and do not limit the invention and that the invention will be defined by the appended claims.

BRIEF DESCRIPTION OF THE DRAWING

In the drawing, FIG. 9 is a vertical section through the lower right-hand portion of a second preferred embodiment of air distributing device which is made in accordance with the principles and teachings of the present invention, and it shows the air-throttling member of that air distributing device in position to block the flow of outside air into that air distributing device, FIG. 10 is a vertical section through the structure shown in FIG. 9, but it shows the air-throttling member in the position it occupies when it directs outside air into the vertically-directed air-guiding section of that air distributing device, and FIG. 11 is a partially broken-away, vertical section through the lower right-hand portion of a third preferred embodiment of air distributing device which is made in accordance with the principles and teachings of the present invention.

DESCRIPTION OF THE PREFERRED EMBODIMENT

Figure 1:
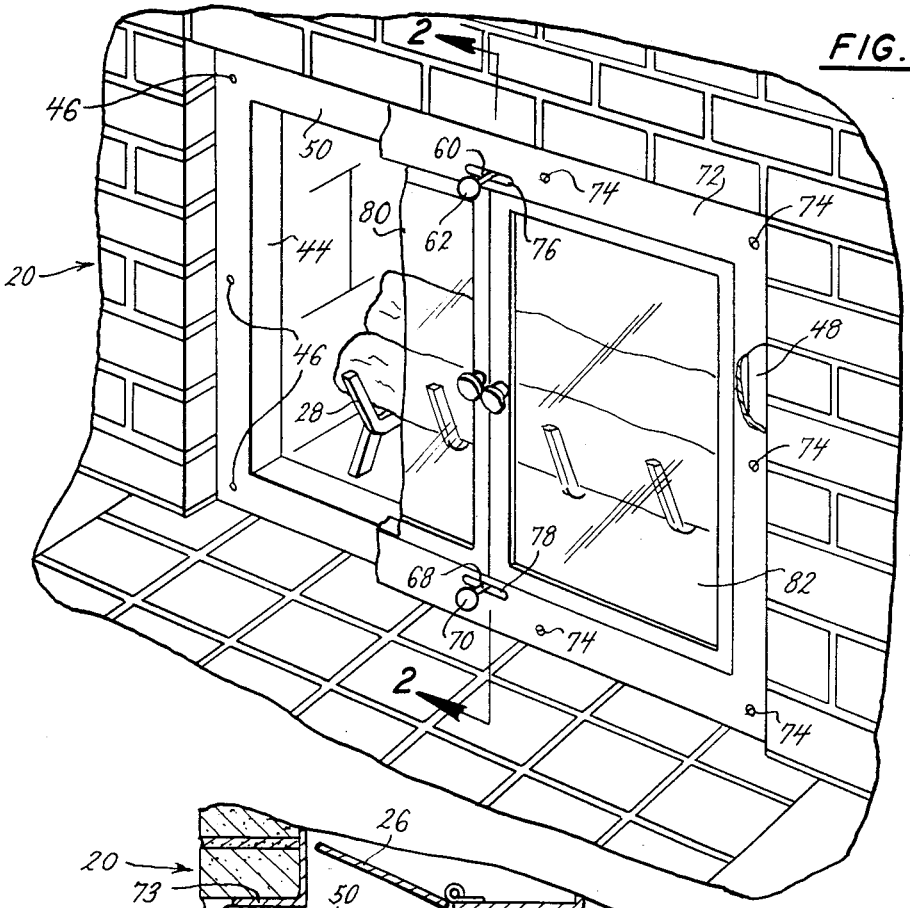
FIG. 1 is a partially broken-away perspective view of a fireplace and of part of a preferred embodiment of air distributing device which is made in accordance with the principles and teachings of the present invention.

Referring to the drawing in detail, the numeral 20 generally denotes a fireplace which has a rectangular opening 22, a back wall 24, and a damper 26. That fireplace is dimentioned to accommodate a log basket 28 which is shown with three logs therein. The numeral 30 denotes a conduit or passage which extends to the exterior of the building of which the fireplace is a part, as shown particularly by FIG. 2. That conduit has a vertically-directed arm 32 which extends upwardly toward the level of the floor of the fireplace 20; and that arm is located inwardly of the plane of the wall of which the fireplace 20 is a part. That arm can be circular, rectangular or irregular in plan view; but it should have an area at least as great as that of a four-inch circle.

The fireplace 20 and its opening 22, back wall 24, damper 26, log basket 28, conduit 30 and vertically-directed arm 32 are of standard and usual design and are not, per se, parts of the present invention. Further, the present invention is not restricted to use with a fireplace which has the proportions and configurations of the fireplace 20. Instead, that invention can be dimensioned and formed to be usable with any fireplace which has a conduit that supplies outside air to that fireplace. The air distributing device of the present invention can be made in different sizes to fit any desired rectangular fireplace opening. In addition, if that air distributing device was to be used with a fireplace opening which was not rectangular, suitable baffles could be provided to bridge any spaces between the outer periphery of that air distributing device and any non-linear portions of that fireplace cpening.

The numeral 34 denotes a lower air-guiding section of the air distributing device which is provided by the present invention; and that lower air-guiding section is shown as an elongated channel with inturned flanges. That channel is mounted so it has an open bottom; and the inturned flanges on that bottom are short enough to provide a substantial air inlet 36 for that lower air-guiding section. As indicated particularly by FIGS. 2 and 6–8, the bottom of the lower air-guiding section 34 is located within an elongated recess in the floor of the fireplace. The bottom of that recess will effectively close the major portion of the length of the open bottom of the lower air-guiding section 34; but the vertically-directed arm 32 of the air conduit 30 will permit air from that conduit to enter that lower air-guiding section. By using a channel as the lower air-guiding section 34, and by disposing the bottom of that lower air-guiding section within an elongated recess in the floor of the fireplace which communicates with the vertically-directed arm 32 of the conduit 30, the present invention enables the air distributing device to communicate with that vertically-directed arm whether that vertically-directed arm is in the center of the fireplace opening 22, is at one or the other of the ends of that fireplace opening, or is somewhere between that center and one of those ends. In doing so, the present invention provides an air distributing device which can be used with almost every fireplace which has a conduit for outlet air that communicates with an elongated recess in the floor of that fireplace.

The air distributing member of the present invention also is usable with a fireplace which has an outside air conduit but does not have an elongated recess in the floor of that fireplace. In such a case, suitable stops could be seccured to the floor of the fireplace by cement, lag screws, recessing or the like, and then the inner face of the lower air-guiding section 34 could be abutted against them. Thereafter, a sealant, such as cement, a baffling strip or the like could be provided to seal the joint between the floor of the fireplace and the outer wall of the lower air-guiding section 34; and a further sealant could be provided to seal the joint between that floor and the inner wall of that lower air-guiding section. Consequently, the air distributing device of the present invention is usable with almost every fireplace which has a conduit for outside air.

The numeral 38 denotes air outlet ports which are provided in the upper portion of the inner wall of the lower air-guiding section 34. Those air outlet ports are shown as being circular in elevation; but they could be given polygonal, arcuate or planar-arcuate configurations of any desired kind. The numeral 40 denotes an ear which is formed by punching it out of the inner wall of the left-hand section 44. The resulting opening, which is formed in that inner wall by the punching operation, is denoted by the numeral 42. The ear 40 is shown adjacent one end of the lower air-guiding section 34; and a second ear 40, not shown, will be provided adjacent the opposite end of that lower air-guiding section.

Figure 5:
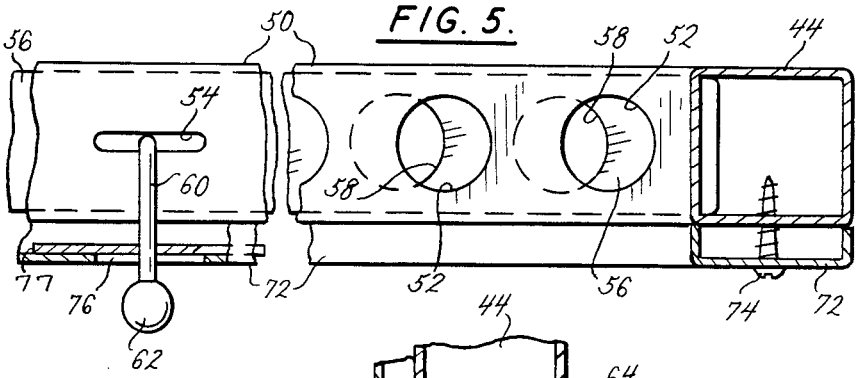
FIG. 5 is a broken sectional view, on the scale of FIG. 3, which is taken along the plane indicated by the line 5—5 in FIG. 4.
Figure 8:
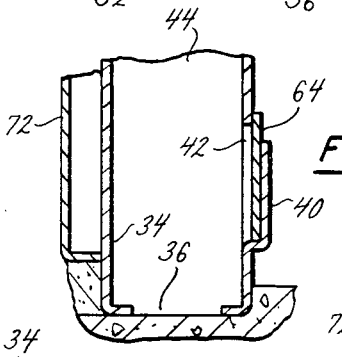
FIG. 8 is a sectional view, on the scale of FIG. 3, which is taken along the plane indicated by the line 8—8 in FIG. 7.

The numeral 44 denotes the left-hand section of the air distributing device; and, as indicated particularly by FIG. 5, that left-hand section is tubular, has a rectangular cross section, and has a closed top and a closed bottom. As indicated particularly by FIG. 7, an opening 39 in the inner face of that left-hand section, adjacent the lower end of that left-hand section, is welded to the left-hand end of the lower air-guiding section 34. As a result, that opening can receive outside air from the left-hand end of the lower air-guiding section 34. Three openings 46, which are shown particularly by FIG. 1, are provided in the front of the left-hand section 44. One of those openings is close to the upper end of that section, another of those openings is close to the lower end of that section, and the remaining opening is midway between those two openings. At least one opening 46, not shown, is provided in the outer wall of the lower air-guiding section 34.

The numeral 50 denotes an upper air-guiding section for the air distributing device. As shown particularly by FIG. 4, an opening 51 in the inner face of the left-hand section 44, adjacent the upper end of that left-hand section, is secured, as by welding, to the left-hand end of the upper air-guiding section 50. As a result, that opening can supply outside air from that left-hand section to that upper air-guiding section.

The numeral 48 denotes the right-hand section of the air distributing device; and it is a mirror image of the left-hand section 44. An opening, not shown, in the inner face of that right-hand section, adjacent the lower end of that right-hand section, is secured, as by welding, to the right-hand end of the lower air-guiding section 34. A further opening, not shown, in the inner face of the right-hand section 48, adjacent the upper end of that right-hand section, is secured, as by welding, to the right-hand end of the upper air-guiding section 50. Those openings enable that right-hand section to receive outside air from the lower air-guiding section and guide it to that upper air-guiding section. The front of the right-hand section 48 has three openings 46, not shown, therein which are comparable to the three openings 46 in the front of the left-hand section 44. The upper air-guiding section has at least one opening 46, not shown, in the outer wall thereof.

The upper air-guiding section 50 is shown as an elongated tubular member which is rectangular in cross section. The numeral 52 denotes air outlet ports in the bottom of that upper air-guiding section. As shown particularly by FIG. 5, those air outlet ports are circular in configuration; but they could be given polygonal, arcuate, or planar-arcuate configurations of any desired kind. The numeral 54 denotes an elongated slot which is provided in the bottom of the upper air-guiding section 50; and that slot has the long axis thereof parallel to the long axis of that upper air-guiding section.

The air outlet ports 38 in the lower air-guiding section 34 preferably are distributed uniformly along the major portion of the length of the inner wall of that lower air-guiding section. Similarly, the air outlet ports 52 in the upper air-guiding section 50 preferably are distributed uniformly along the major portion of the length of the bottom of that upper air-guiding section. However, if desired, those outlet ports could be arranged in various groupings that were spaced apart any desired distances along the lengths of those air-guiding sections.

Figure 4:
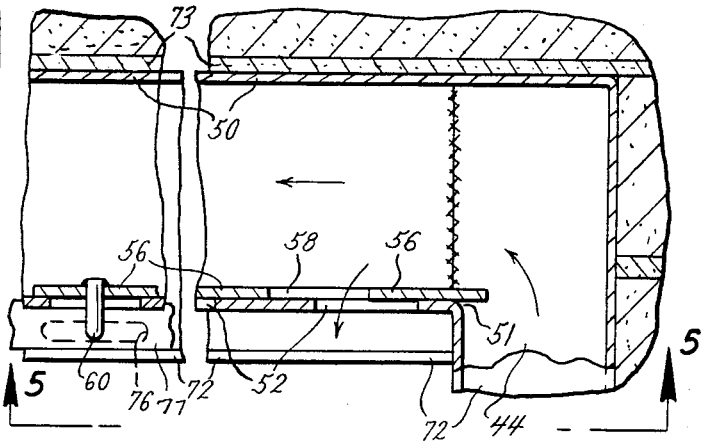
FIG. 4 is a broken sectional view, on the scale of FIG. 3, which is taken along the plane indicated by the line 4—4 in FIG. 3.

The numeral 56 denotes an air-throttling member which has the form of an elongated plate with a number of openings 58 therein. That air-throttling member will be preitioned within the upper air-guiding section 50 before the ends of that upper air-guiding section are secured, as by welding, to the openings in the upper portions of the inner faces of the left-hand and right-hand sections 44 and 48. The openings 58 in the air-throttling member 56 are dimensioned and spaced so the portions of that air-throttling member which are intermediate those openings can be moved into register with the air outlet ports 52 to close those ports. The openings 58 also are dimensioned and spaced so they can be moved into partial registry with those air outlet ports, as shown in FIGS. 4 and 5, or can be moved into full registry with those air outlet ports. The air-throttling member 56 is readily slidable, in a direction which is parallel to the axis of the upper air-guiding section 50, for a distance which is only slightly less than the length of the elongated slot 54. The numeral 60 denotes an actuator which is L-shaped in configuration, and which has the short arm thereof extending upwardly through the elongated slot 54 and through an opening in the air-throttling member 56. That actuator preferably is fixedly secured to that air-throttling member by having the upper end of the short arm thereof welded to that air-throttling member.

When that actuator is at the left-hand end of the slot 54, as that slot is viewed in FIGS. 4 and 5, the portions of that air-throttling member which are displaced from the openings 58 will overlie and completely close the air outlet ports 52. On the other hand, when that actuator is adjacent the right-hand end of slot 54, the openings 58 will essentially be in register with the air outlet ports 52, and hence will permit substantial quantities of outside air to flow downwardly from the upper air-guiding section 50 through those openings and then through those air outlet ports and into the fireplace. A knob 62, which is shown as being spherical but which could be given any desired functional or ornamental configuration, is secured to the outer end of the long arm of the actuator 60.

Figure 7:
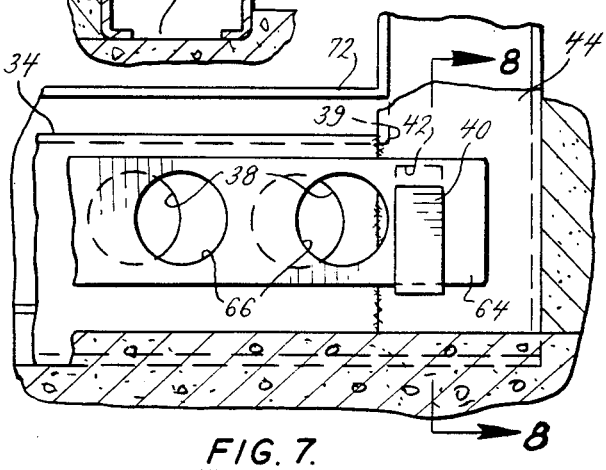
FIG. 7 is a rear elevational view, on the scale of FIG. 3, which is taken along the plane indicated by the line 7—7 in FIG. 6.

The numeral 64 denotes an air-throttling member which has the form of an elongated plate with a number of openings 66 therein. Those openings are dimensioned and spaced so the portions of that air-throttling member which are displaced from those openings can be moved into register with the air outlet ports 38 to close those ports. The openings 66 also are dimensioned and spaced so they can be moved into partial registry with those air outlet ports, as shown in FIG. 7, or can be moved into full registry with those air outlet ports. The air-throttling member 64 is readily slidable, in a direction which is parallel to the axis of the lower air-guiding section 34, for a distance which is about the same as the distance through which the air-throttling member 56 is slidable. The numeral 68 denotes an L-shaped actuator which has the vertically-directed short arm thereof secured, as by welding, to the inner face of the air-throttling member 64. A knob 70, which is shown as being spherical but which could be given any desired functional or ornamental configuration, is secured to the outer end of the long arm of the actuator 68.

The numeral 72 denotes a frame for glass doors. That frame can be made in any desired manner; but it is economical to make that frame from four channels which are suitably secured together, as by welding, to define a rectangular frame. The open sides of those channels confront, and are largely closed by, the outer walls of the lower air-guiding section 34, of the side sections 44 and 48, and of the upper air-guiding section 50. The peripheral dimensions of that frame will be essentially the same as the peripheral dimensions of the fireplace opening, as indicated particularly by FIGS. 1 and 2. Filling material, which can be cement or any other suitable material, can be interposed between an angle iron 73 at the upper portion of the fireplace opening 22 and the upper surfaces of the upper air-guiding section 50 and of frame 72. Similar filling material can be interposed between the left-hand side of the fireplace opening 22 and the outer faces of the frame 72 and of the left-hand section 44. Further filling material, not shown, can be interposed between the right-hand side of the fireplace opening 22 and the outer faces of the right-hand section 48 and of the frame 72. Additional sealing material can be interposed between the floor of the fireplace and the surface of the bottom of the frame 72. Self-tapping metal screws 74 can be passed rearwardly through a number of openings in the front face of the frame 72 and seated within the openings 46 in the front walls of the lower air-guiding section 34, of the left-hand section 44, of the right-hand section 48, and of the upper air-guiding section 50. Those screws will fixedly secure the frame 72 to the four sections of the air distributing device.

A horizontally-directed slot 76 is provided in the front wall of the upper portion of the frame 72, as indicated particularly by FIGS. 1–5. The axis of slot 76 is parallel to the long axis of the upper air-guiding section 50; and its length is at least as great as the length of the elongated slot 54 in the bottom of that upper air-guiding section. The slot 76 is oriented relative to the slot 54 so the actuator 60 can be moved far enough through the slots 54 and 76 to shift the openings 58 in the air-throttling member 56 wholly out of, or essentially into, register with the air outlet ports 52 in the bottom of the upper air-guiding section 50. A baffle plate 77, which moves with the actuator 60, will resist any flow of air through the slot 76.

Figure 6:
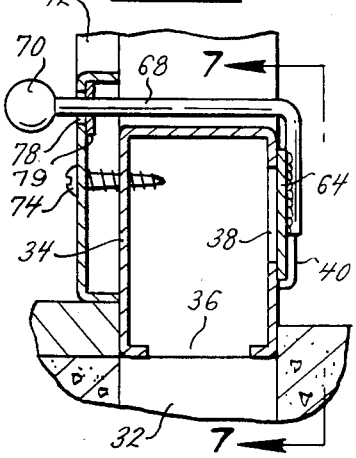
FIG. 6 is a sectional view, on the scale of FIG. 3, which emphasizes the lower air-guiding section of the air distributing device, and which is taken along the plane indicated by the line 2—2 in FIG. 1.

The numeral 78 denotes a horizontally-directed slot in the front of the bottom portion of the frame 72; and that slot is shown particularly by FIG. 6. The elongated axis of that slot is parallel to the long axis of the lower air-guiding section 34; and the length of that slot is great enough to permit the actuator 68 to move the openings 66 in the air-throttling member 64 wholly out of, or essentially into, register with the air outlet ports 38 in the rear wall of that lower air-guiding section. A baffle plate 79, which moves with the actuator 68, will resist any flow of air through the slot 78. The actuator 68 is wholly independent of the actuator 60; and, as a result, the air-throttling member 64 can be moved while the air-throttling member 56 is left motionless, and vice versa. The air-throttling member 56 will usually be in port-closing position whenever the air-throttling member 64 is out of port-closing position. Conversely, the air-throttling member 64 will usually be in port-closing position whenever the air-throttling member 56 is out of port-closing position.

The numeral 80 denotes a glass door, of standard and usual design, which is pivoted to the left-hand end, not shown, of the frame 72. The numeral 82 denotes a glass door, of standard and usual design, which is pivoted to the right-hand portion of that frame. Those doors can be opened to permit the introduction of logs or of other combustible material into the fireplace, and they also can be opened to remove ashes or to facilitate the cleaning of the fireplace. However, those doors should be kept closed whenever a fire has been started in the fireplace—especially when a reduced pressure is likely to develop within the room, of which the fireplace is a part. That reduced pressure could be due to the operation of an exhaust fan in the kitchen, bathroom, or another room of the building, could be due to the "stack" effect of the building, to heavy winds or other conditions.

Whenever the fireplace is not in use, the damper 26 should be closed, the air-throttling member 64 should be in its "closed" (left-hand) position in FIG. 1 (right-hand position in FIG. 7) to block all of the air outlet ports 38, and the air-throttling member 56 should be in its "closed" (right-hand) position in FIG. 1 (left-hand position in FIG. 5) to block all of the air outlet ports 52. Suitable "open" and "closed" notations will be stamped into, imprinted on, or otherwise caused to appear on the upper and lower portions of the frame 72 adjacent the ends of the slots 76 and 78. At such time, those air-throttling members will coact with the rest of the air distributing device to minimize any tendency of air to pass inwardly through the conduit 30, to pass upwardly through the vertically-directed arm 32, and then to pass through that air distributing device into the fireplace and up the chimney.

When a fire is to be started, the damper 26 will be opened, but the knob 62 and the actuator 60 will be left in their "closed" (right-hand) positions in FIG. 1 to keep the air outlet ports 52 in the bottom of the upper air-guiding section 50 of the air distributing device closed. If the chimney is cold, and if the un-blocking of the air outlet ports 38 in the lower air-guiding section 34 would tend to cause the cold air in the conduit 30 to draw air downwardly from the fireplace, the knob 70 and the actuator 68 should be left in their "closed" (left-hand) positions in FIG. 1. On the other hand, if the chimney is warm, or if the un-blocking of the air outlet ports 38 in the lower air-guiding section 34 would not tend to cause the cold air in the conduit 30 to draw air downwardly from the fireplace, the knob 70 and the actuator 68 should be shifted to their "open" (right-hand) positions in FIG. 1.

After a fire is started, the knob 62 and the actuator 60 will be permitted to remain in their "closed" (right-hand) positions in FIG. 1. However, the knob 70 and the actuator 68 will be moved to a position wherein the openings 66 in the air-throttling member 64 will unblock enough of the areas of the air outlet ports 38 to enable outside air from the conduit 30 to support the fire. That outside air will move inwardly through that conduit, upwardly through the arm 32, along the lower air-guiding section 34 to the air outlet ports 38, and then through those air outlet ports into the fireplace. The greater the extent to which the areas of the air outlet ports 38 are uncovered, the faster the logs or other fuel will burn; and the lesser the extent to which the areas of those openings are uncovered, the slower the logs or other fuel will burn. The glass doors 80 and 82 can be left open or can be closed, as desired by the user. However, if those doors are closed, a reduced pressure in the room, of which the fireplace is a part, will be unable to draw carbon monoxide or any other products of combustion into the room. Also, no sparks can escape from the fireplace to ignite a rug or any other combustible object. In addition, very little of the warm air in the room will be drawn up the chimney.

During the late hours of the night and the early hours of the morning, or during any other period of time in which slow combustion of the logs or other fuel is desired, the actuator 68 and the knob 70 should be shifted to their "closed" (left-hand) positions in FIG. 1 to cause the air-throttling member 64 to block the air outlet ports 38. The actuator 60 and the knob 62 should be shifted to their "open" (left-hand) positions in FIG. 1 to dispose the openings 58 in the air-throttling member 56 in essential registry with the air outlet ports 52. At such time, air will move inwardly through the conduit 30, upwardly through the arm 32, through the lower air-guiding section 34 to the side sections 44 and 48, upwardly through those side sections, through the upper air-guiding section 50, through the openings 58 to the air outlet ports 52, and then through those air outlet ports into the fireplace. That air will be introduced into that fireplace at a level which is above the logs or other fuel; and hence it will pass up the chimney. That air will be helpful in minimizing the deposit of any solid products of combustion on the interior of the chimney and on portions of the fireplace.

By setting the knob 62 and the actuator 60 in their closed (right-hand) positions in FIG. 1, and by appropriate setting of the knob 70 and actuator 68 in partially-open or in "open" (right-hand) position in FIG. 1, it is possible to assure safe and full combustion of the logs or other fuel at the desired rate. Subsequently, by setting the knob 70 and actuator 68 in their "closed" (left-hand) positions in FIG. 1, and by setting the knob 62 and the actuator 60 in their "open" (left-hand) positions in FIG. 1, it is possible to permit the logs or other fuel to burn at a "slow fire" rate and to minimize the deposit of any solid products of combustion on the interior of the chimney and on portions of the fireplace.

The sides and rear wall of the fireplace are shown as being formed from bricks or ceramic blocks. If desired, those side walls and that rear wall could be the metal walls of a pre-formed fireplace which is intended to heat air that passes along the exterior surfaces of those metal walls. In fact, the air distributing device of the present invention is usable, either directly or by the use of appropriate baffling, with almost every conceivable form of fireplace in use today.

FIG. 5 shows the right-hand opening 58 in the air-throttling member 56 close to the right-hand end of that air-throttling member; and such an arrangement is practical. However, in most installations, the endmost openings in that air-throttling member will have all portions thereof displaced at least two inches inwardly from the ends of that air-throttling member. Similarly, in most installations, the endmost openings 66 in the air-throttling member 64 will have all portions thereof displaced at least two inches inwardly from the ends of that air-throttling member.

The ear 40 in FIG. 7, and the corresponding ear 40 adjacent the other end of the lower air-guiding section 34, will hold the air-throttling member 64 immediately adjacent the inner wall of that lower air-guiding section. As a result, although that air-throttling member will be movable relative to that inner wall, it will be close enough to that inner wall to keep outside air from being drawn through the air outlet ports 38 whenever that air-throttling member is in the "closed" (left-hand) position in FIG. 1. FIG. 7 shows the right-hand end of the air-throttling member 64 closing the opening 42 which was formed in the inner wall of the left-hand section 44 when the ear 40 was formed. That right-hand end will close that opening in all moved positions of that air-throttling member. Similarly, the left-hand end of the air-throttling member 64 will close the opening 42 adjacent the other end of the lower air-guiding section 34.

As a result, those openings will not constitute undesired air outlet ports.

The air-throttling member 56 will rest upon the upper face of the bottom of the upper air-guiding section 50; and hence, although that upper air-guiding section will be movable relative to that upper face, it will be close enough to that upper face to keep outside air from being drawn through the air outlet ports 52 whenever that air-throttling member is in the "closed" (right-hand) position in FIG. 1. Also, that air-throttling member will effectively prevent loss of outside air through the slot 54, regardless of the positions in which that air-throttling member is set.

Figure 2:
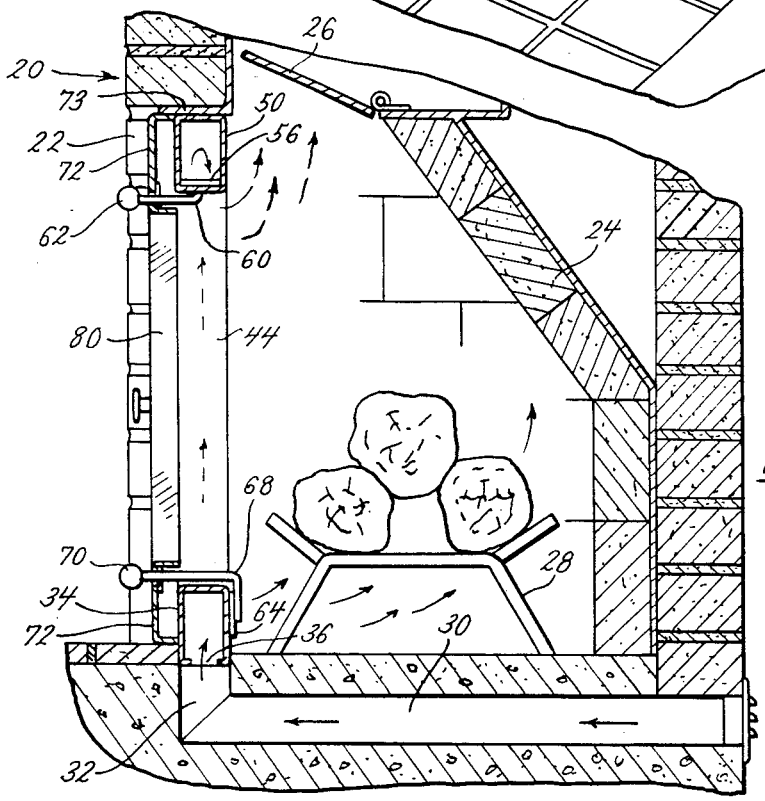
FIG. 2 is a sectional view, on a larger scale, which is taken along the plane indicated by the line 2—2 in FIG. 1.
Figure 3:
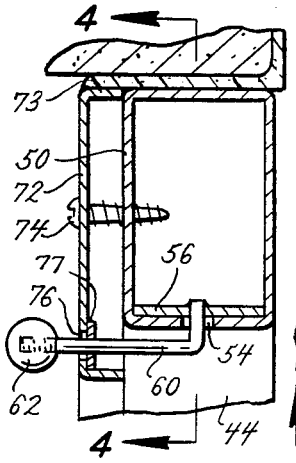
FIG. 3 is a sectional view, on a still larger scale, which emphasizes the upper air-guiding section of the air distributing device, and which is taken along the plane indicated by the line 2—2 in FIG. 1.

The knob 62 is larger than the height of slot 76, and the knob 70 is larger than the height of slot 78, as indicated by FIGS. 1 and 2. Consequently, those knobs will not be secured to the actuators 60 and 68, respectively, until the frame 72 has been secured to the sections 34, 44, 48 and 50 of the air distributing device.

The front faces of the air-guiding sections 34, 44, 48 and 50 of the air distributing device are planar and smooth, and hence make it possible to provide a relatively air-tight engagement between those front faces and the rear surface of the frame 72. As a result, the air distributing device not only serves to support the frame 72 but also helps prevent the escape of air between itself and that frame. In addition, the air distributing device performs at least two further functions; namely, blocking heat that otherwise would be radiated onto the rear surface of the frame 72, and absorbing heat from that frame. In doing so, the air distributing device keeps the temperature of frame 72 low enough so that frame cannot burn a person's hand.

Specifically, as indicated by FIG. 5, the air-guiding sections 44 and 48 will keep radiated heat from reaching any parts of the rear surfaces of the vertically-directed portions of frame 72; and, as indicated by FIG. 2, the air-guiding sections 34 and 50 will keep radiated heat from reaching most parts of the rear surfaces of the horizontally-directed portions of that frame. By keeping the major portion of the rear surface of the frame 72 free from radiated heat, the air-distributing device limits the level to which the temperature of that frame can rise. The air distributing device also limits the level to which that temperature can rise by absorbing heat from that frame. The outside air which flows through the lower air-guiding section 34 to the air outlet ports 38 will keep that air-guiding section cool, and will thereby enable the air distributing device to absorb heat from the frame 72. Where the outside air flows through the air-guiding section 34 to the air-guiding sections 44 and 48, and then flows upwardly to and through the upper air-guiding section 50 to the air outlet ports 52, that outside air will enable the air distributing device to absorb even more heat from that frame.

By serving as a barrier to most of the radiated heat which otherwise would directly reach the frame 72, the air distributing device reduces the total amount of heat received by that frame. Also, by being kept cool by the outside air which flows through the air-guiding sections thereof, and by being secured in heat-exchanging relation to the frame 72, the air distributing device cools that frame. The overall result is that the air distributing device keeps the temperature of frame 72 well below the level at which a person's hand could be burned.

As indicated particularly by FIG. 6, inner wall of the lower air-guiding section 34 will act as a curb for ashes. As a result, the hearth or floor in front of that air-guiding section can be kept quite free of ashes.

Where the air distributing device of the present invention is to be incorporated into a fireplace as that fireplace is being built, that air distributing device will perform an additional function. Specifically, that air distributing device will serve as a jamb, head and sill for bricks which are laid by the brick layer or for the stones which are set by the stone mason. In serving as a jamb, head and sill, the air distributing device speeds up the building of the fireplace, and also provides a desirably close relationship between itself and the sides and top of the fireplace opening.

The spaced air outlet ports 52 and the air-throttling member 56 provide a desirable way of controlling the amount of above-fire air which can be supplied to the fireplace. If desired, however, other air-metering arrangements could be used. For example, an elongated alot could be provided in the air-guiding section 50; and an imperforate, elongated air-throttling member could be moved transversely of that slot to vary the amount of above-fire air which could be supplied to the fireplace. Similarly, the spaced air outlet ports 38 and the air-throttling member 64 provide a desirable way of controlling the amount of combustion-supporting air which can be supplied to the fireplace. If desired, however, other air-metering arrangements could be used. For example, an elongated slot could be provided in the air-guiding section 34, and an imperforate, elongated air-throttling member could be moved transversely of that slot to vary the amount of combustion-supporting air which could be supplied to the fireplace. Also, outlet ports could be provided in the air-guiding sections 34 and 50 which had hinged closures therefor. Actuators for those closures could then be used to selectively dispose those hinged closures in fully-closed, fully-open or intermediate positions to provide desired amounts of combustion-supporting air, desired amounts of over-fire air, and desired ratios of combustion-supporting and over-fire air. The particular form and location of air outlet ports and the particular form and manner of operation of air-throttling members can be varied as desired, as long as they permit selective supplying of combustion-supporting air and over-fire air.

Referring particularly to FIGS. 9 and 10, the numeral 90 denotes the vertically-directed arm of a passage, not shown, which extends to the exterior of the building in which the air distributing device of FIGS. 9 and 10 is mounted. That passage can be identical to the passage 30 of FIG. 2; but the arm 90 should have a horizontal length that is twice the vertical dimension of that passage—so the area of that arm is at least twice the area of a vertical section through that passage. The numeral 92 denotes the bottom horizontally-directed air-guiding section of the air distributing device of FIGS. 9 and 10; and that air-guiding section is a rectangular tube in cross section. An opening 94 is provided in the bottom of that section in register with the upwardly-directed arm 90; and that opening and that arm should have widths that are equal to the width of the passage for outside air while having horizontal lengths that are twice the height of that passage. The numeral 96 denotes an elongated, horizontal outlet port which extends throughout a large portion of the length of the inner wall of the air-guiding section 92. If desired, that outlet port could be formed as a number of closely-spaced, horizontally-aligned slots, could be made trapezoidal in form so its height tapered from right to left, or could be given any other desired configuration. That outlet port differs from the various outlet ports in FIGS. 4–8 in not having an air-throttling member immediately adjacent it. An elongated narrow slot 98 is provided in the upper surface of the air-guiding section 92; and the numeral 100 denotes a stationary baffle which spans the distance from the rear wall to the front wall of that air-guiding section. As shown particularly by FIGS. 9 and 10, the bottom of that baffle is located approximately midway between the opposite ends of the opening 94; and that baffle coacts with the top of the air-guiding section 92 to subtend an angle of about forty-five degrees.

The numeral 102 denotes a vertically-directed air-guiding section which has an opening 103 in the lower portion of the left-hand wall thereof. The right-hand end of the air-guiding section 92 is suitably secured, as by welds, to that opening. The air-guiding section 102 extends upwardly toward the top of the fireplace opening; and it will be suitably secured, as by welds, to a horizontally-directed upper air-guiding section, not shown. That upper air-guiding section will be tubular, and it will have an elongated outlet port which is comparable to the elongated outlet port 96. However, that upper air-guiding section will not have an opening like the opening 94, it will not have a slot like the slot 98, and it will not have a baffle like the baffle 100. The outlet port 96 and the corresponding outlet port in the upper air-guiding section will open into the fireplace.

Unlike the air distributing device of FIGS. 1–8, the air distributing device of FIGS. 9 and 10 will have only one vertically-directed air-guiding section. As a result, the air-guiding section 102 must have a horizontal cross-section which is large enough to enable it to supply all of the outside air which must be supplied to the upper air-guiding section that is connected to the upper end thereof.

The numeral 104 denotes a plate-like air-throttling member which is disposed within and which rests upon the bottoms of the air-guiding sections 92 and 102. An opening 106 is provided in the right-hand portion of that air-throttling member; and the area of that opening is about the same as one-half of the horizontal area of the vertically-directed arm 90. The numeral 108 denotes an L-shaped actuator which has a vertically-directed portion that is secured to the left-hand part of the air-throttling member 104 and that extends upwardly through the elongated slot 98. That actuator has a forwardly-extending horizontal portion which will extend through a frame, not shown, like the frame 72, that will be secured to the front of the air distributing device. A knob, which is similar to either of the knobs 62 and 70, will be secured to the forward end of the horizontally-directed arm of actuator 108.

During all periods of time when the fireplace is not in use, the air-throttling member 104 should be in the position shown by FIG. 9. As long as that air-throttling member is in that position, the imperforate left-hand half of that member will be in register with, and will block, the opening 94 and the upwardly-directed arm 90. As a result, outside air will not be permitted to be drawn into the air distributing device.

Whenever combustion-supporting air is desired, the actuator 108 will be moved to the left-hand end of the slot 98 to move the opening 106 in the air-throttling member 104 to a position where it is between the bottom edge of baffle 100 and the left-hand edge of opening 94. At such time, the right-hand portion of that air-throttling member will span the portion of the opening 94 which is intermediate that bottom edge and the right-hand end of that opening. As a result, outside air will be able to pass inwardly through the passage, upwardly through the arm 90, through the left-hand half of the opening 94, through the air-guiding section 92, and to and through the outlet port 96. Some small amounts of air also could pass through the slot 98 into the fireplace. The outside air which passes through the outlet port 96, and the small amount of air which passes through the slot 98, will fully support the combustion of any logs or other fuel in the fireplace.

Whenever it is desirable to provide over-fire air, the air-throttling member 104 will be set in the position shown by FIG. 10. At such time, the opening 106 will be in register with the right-hand half of the opening 94; and the left-hand half of that opening will be blocked by the imperforate left-hand portion of that air-throttling member. Suitable markings will be provided on the frame, which is similar to the frame 72, to indicate when the air-throttling member 104 is in its "full fire" position or its "hold fire" position.

The air-throttling member 104 can be set in a multitude of specifically-different positions to provide various ratios of combustion-supporting and over-fire air. For example, if that air-throttling member were to be set so the opening 106 therein had the mid-point thereof in register with the bottom edge of the baffle 100, equal amounts of air could be drawn through the bottom air-guiding section 92 and the upper air-guiding section, not shown. The closer the air-throttling member 104 was moved from that mid position toward its left-hand position, the greater would be the ratio between the air passing into the bottom air-guiding section and the air passing into the upper air-guiding section. Contrariwise, the further that air-throttling member was moved from that mid position toward its right-hand position, the smaller would be the ratio between the air passing to the bottom air-guiding section 92 and the air moving to the upper air-guiding section.

Referring particularly to FIG. 11, the numeral 114 denotes a vertically-directed arm which extends upwardly from a passage for outside air. That arm and that passage can be similar to the arm 32 and the passage 30 of FIG. 2. The numeral 116 denotes the bottom horizontally-directed air-guiding section of the air distributing device of FIG. 11; and that air-guiding section is tubular in vertical section. An elongated outlet port 118 is provided in the inner wall of that section. If desired, that elongated outlet port could be made as a number of spaced horizontally-aligned slots, could be made trapezoidal in form so it tapered from right to left, or could be given any other desired form.

The numeral 120 denotes a vertically-directed air-guiding section which has an open bottom 122 and which has an opening 123 in the lower portion of the left-hand wall thereof. The right-hand end of the bottom air-guiding section 116 is secured, as by welds, to the opening 123. The numeral 124 denotes a semi-circular slot which is dominantly in the front wall of the vertically-directed air-guiding section 120 but which extends a short distance into the front wall of the horizontally-directed air-guiding section 116. The geometric center of that slot is close to the junction between the upper edge of the air-guiding section 116 and the upper edge of the opening 123 in the air-guiding section 120.

The numeral 126 denotes a T-shaped air-throttling member which is disposable within either or both of the air-guiding sections 116 and 120. The numeral 127 denotes an axis of rotation for that air-throttling member; and that axis can be established by ears at the opposite edges of the end of the stem of that air-throttling member, by an elongated rod which is welded to the end of that stem, or by any other mechanical arrangement. That T-shaped air-throttling member has a threaded stud 128 on the forward edge of the stem thereof, and that stud extends forwardly through the semi-circular slot 124. A setting nut 130 is threaded onto that stud; and that nut can be tightened against the front face of air-guiding section 116 or 120 to lock the air-throttling member 120 against movement.

During all periods of time when the fireplace is not in use, the air-throttling member 126 should be in the solid-line position shown by FIG. 11. As long as that air-throttling member is in that position, the transverse portion of that member will extend from the left-hand edge of the opening 122 in the bottom of the air-guiding section 120 to the right-hand wall of that air-guiding section to completely block the flow of outside air from the upwardly-directed arm 114 into either of the air-guiding sections 116 or 120.

Whenever combustion-supporting air is desired, the setting nut 130 will be loosened, the air-throttling member 126 will be rotated in the counterclockwise direction from its solid-line position to its upper dotted-line position, and then that nut will be tightened. At such time, outside air can flow from the upwardly-directed arm 114 through the opening 122, through the bottom of the air-guiding section 120 into the air-guiding section 116, and then outwardly through the outlet port 118 into the fireplace. That outside air will fully support the combustion of the logs or other fuel in the fireplace. The transverse portion of the air-throttling member will fully prevent the flow of outside air up to the upper air-guiding section.

Whenever it is desirable to provide over-fire air, the setting nut 130 will be loosened, the air-throttling member 126 will be rotated in the clockwise direction to the lower dotted-line position, and then that nut will be tightened. At such time, the transverse portion of that member will have the right-hand end thereof adjacent the left-hand edge of the opening 122 and will have the left-hand portion thereof adjacent the top of the air-guiding section 116. Outside air will then be drawn upwardly through the arm 114, through the opening 122, through the air-guiding section 120 to the upper air-guiding section, and then to the outlet port which corresponds to the outlet port 118.

The solid-line position and the two dotted-line positions for the air-throttling member 126 will be the positions in which that air-throttling member will usually be disposed. However, that air-throttling member could be disposed in an infinite number of positions which are intermediate those two dotted-line positions; and that air-throttling member could provide varying ratios of combustion-supporting and over-fire air in those various positions.

The structure of FIGS. 1–8 is preferred because it can be used with fireplaces in which the upwardly-directed arm 32 is located anywhere between the opposite sides of that fireplace. In contrast, the air distributing device of FIGS. 9 and 10 requires the upwardly-directed arm 90 to be spaced just a short distance to the left of the right-hand edge of the fireplace opening; and the air distributing device of FIG. 11 requires the upwardly-directed arm 114 to be located adjacent the right-hand edge of the fireplace opening.

Whereas the drawing and accompanying description have shown and described some preferred embodiments of the present invention, it should be apparent to those skilled in the art that various changes may be made in the form of the invention without affecting the scope thereof.

What I claim is:

1. An aspiration-type air distributing device, for a fireplace which is equipped with a conduit that has an outlet adjacent said fireplace to permit outside air to be aspirated to and into said fireplace at pressures below ambient pressure, a first metal air-guiding section that is disposable adjacent the bottom of the fireplace opening and that has at least one air outlet port, said metal air-guiding section having an elongated slot in the bottom thereof that is disposable in register with said outlet of said conduit and that is adapted to receive outside air which is freely aspirated inwardly through said conduit, said elongated slot having a length which is many times greater than the largest transverse dimension of said outlet of said conduit so said outlet of said conduit can be disposed in any one of a number of positions along the length of said elongated slot and yet supply outside air to said metal air-guiding section, said bottom of said air-guiding section being adapted to coact with said bottom of said fireplace opening to effectively close said slot at points which are displaced from said outlet of said conduit, said air outlet port being positioned to permit outside air that successively passes through said conduit and said metal air-guiding section and said air outlet port to be aspirated into the lower area of said fireplace, a second metal air-guiding section that is disposable adjacent the top of said fireplace opening and that has at least one air outlet port, a generally-vertical air-conducting metal section that is port-free and hence air-tight and that extends to and communicates with said second metal air-guiding section and which communicates with said first metal air-guiding section, and that is adapted to receive outside air which is freely aspirated inwardly through said conduit, said generally-vertical air-conducting section conducting outside air to said second metal air-guiding section with no loss of air, said air outlet port of said second metal air-guiding section being positioned to permit outside air that successively passes through said conduit and said generally-vertical air-conducting section and said second metal air-guiding section and said air outlet port of said second metal air-guiding section to be aspirated into the upper area of said fireplace, and adjustable means which can vary the amount of outside air that can pass successively through said conduit and the first said metal air-guiding section and said air outlet port of said first said metal air-guiding section to be aspirated into said lower area of said fireplace and which can vary the amount of outside air that can pass successively through said generally-vertical air-conducting section and said second said metal air-guiding section to be aspirated into said upper area of said fireplace.

2. An aspiration-type air distributing device as claimed in claim 1 wherein said generally vertically-directed air-guiding section is at one side of said fireplace opening, wherein a second generally vertically-directed air-guiding section is port-free and hence air-tight and is at the opposite side of said fireplace opening and extends to and communicates with the other end of said second metal air-guiding section to conduct outside air up to said other end of said second metal air-guiding section with no loss of air, wherein said generally vertically-directed air-guiding sections are fixedly secured to said one and said other ends of said second metal air-guiding section and also are fixedly secured to the ends of said first said metal air-guiding section to provide a sturdy rectangular air distributing device, wherein the lower ends of said generally vertically-directed air-guiding sections are in communication with said first said metal air-guiding section so outside air can pass between said first said metal air-guiding section and said generally vertically-directed air-guiding sections, wherein a rectangular frame for hinged glass doors can be secured to, and can be supported by, said sturdy rectangular air distributing device, wherein said rectangular air distributing device is disposable immediately adjacent the room-confronting face of said fireplace, and wherein said adjustable means can be adjusted while said hinged glass doors are in closed position.

3. An aspiration-type air distributing device as claimed in claim 1 wherein said air outlet port of said first said metal air-guiding section is close to the floor of said fireplace and is in that face of said first said metal air-guiding section which confronts the interior of said fireplace so air can be aspirated from said air outlet port of said first said metal air-guiding section to the lower section of a fire within said fireplace without having to turn and move downwardly as it flows from said air outlet port of said first said metal air-guiding section to said lower section of said fire, wherein said first said metal air-guiding section has the top thereof disposable close to said floor of said fireplace while being spaced from said floor by a distance greater than the maximum vertical dimension of said air outlet port of said first said metal air-guiding section, and wherein said elongated slot in said first said metal air-guiding section constitutes an inlet that directly confronts said outlet of said conduit whether said outlet for said conduit is at one or the other side of said fireplace or is intermediate said sides, whereby said outside air passes directly from said conduit into said first said metal air-guiding section so outside air which passes to said second metal air-guiding section must pass through at least a portion of the length of said first said metal air-guiding section and then pass through said generally-vertical air-conducting section before it can be aspirated into said second metal air-guiding section.

4. An aspiration-type air distributing device, for a fireplace which is equipped with a conduit that has an outlet adjacent said fireplace to freely permit outside air to be aspirated to and into said fireplace at pressures below ambient pressure, a first metal air-guiding section that is disposable adjacent the bottom of the fireplace opening and that has at least one air outlet port, said metal air-guiding section having an elongated slot in the bottom thereof that is disposable in register with said outlet of said conduit and that is adapted to receive outside air which is freely aspirated inwardly through said conduit, said elongated slot having a length which is many times greater than the largest transverse dimension of said outlet of said conduit so said outlet of said conduit can be disposed in any one of a number of positions along the length of said elongated slot and yet supply outside air to said metal air-guiding section, said bottom of said air-guiding section being adapted to coact with said bottom of said fireplace opening to effectively close said slot at points which are displaced from said outlet of said conduit, said air outlet port being positioned to permit outside air that successively passes through said conduit and said metal air-guiding section and said air outlet port to be aspirated into the lower area of said fireplace, a second metal air-guiding section that is disposable adjacent the top of said fireplace opening and that has at least one air outlet port, a generally-vertical air-conducting metal section that is port-free and hence air-tight and that extends to and communicates with said second metal air-guiding section and that is adapted to receive outside air which is freely aspirated inwardly through said conduit and said first metal air-guiding section, said generally-vertical air-conducting section conducting outside air to said second metal air-guiding section with no loss of air, said air outlet port of said second metal air-guiding section being positioned to permit outside air that successively passes through said conduit and said generally-vertical air-conducting section and said second metal air-guiding section and said air outlet port of said second metal air-guiding section to be aspirated into the upper area of said fireplace, adjustable means which can vary the amount of outside air that can pass successively through said conduit and the first said metal air-guiding section and said air outlet port of said first said metal air-guiding section to be aspirated into said lower area of said fireplace and which can vary the amount of outside air that can pass successively through said generally-vertical air-conducting section and said second said metal air-guiding section to be aspirated into said upper area of said fireplace, said elongated slot in said first said air-guiding section constituting an inlet which is substantially as long as said fireplace is wide to enable said inlet to be disposable in communication with said conduit and thereby permit outside air to be aspirated through said conduit and into and through said first said air-guiding section and into and through said generally-vertical air-conducting section to reach said second air-guiding section whether said outlet of said conduit is at one or the other side of said fireplace or is intermediate said sides, said second metal air-guiding section being disposable below said top of said fireplace opening to define the top of a smaller, metallic opening for said fireplace, said generally-vertical air-conducting section being disposable inwardly of one side of said fireplace opening to define one side of said smaller, metallic opening for said fireplace, and said first said metal air-guiding section being disposable, at least in part, above the bottom of said fireplace opening to define the bottom of said smaller, metallic opening for said fireplace.

5. An aspiration-type air-distributing device as claimed in claim 4 wherein a frame for openable and closable doors is secured to the first said and said second air-guiding sections and defines an even smaller metallic opening for said fireplace, wherein hinges mount openable and closable doors for swinging movement relative to said frame, wherein an air-throttling means is disposed adjacent said air outlet port of said first said metal air-guiding section, wherein a second air-throttling means is disposed adjacent said air outlet port of said second metal air-guiding section, wherein an actuator for the first said air-throttling means is located adjacent, and extends forwardly through, the lower section of said frame and adjacent the top of said first said metal air-guiding section and out of the path of swinging movement of said doors and can be actuated when said doors are in closed position, and wherein an actuator for said second air-throttling means is located adjacent, and extends forwardly through, the upper section of said frame and adjacent the bottom of said second metal air-guiding section and out of the path of swinging movement of said doors and can be actuated when said doors are in closed position.

* * * * *